US008257385B2

(12) United States Patent
Karnwie-Tuah

(10) Patent No.: US 8,257,385 B2
(45) Date of Patent: Sep. 4, 2012

(54) FACELIFT DEVICE

(76) Inventor: Daniel Karnwie-Tuah, Camarillo, CA (US)

( * ) Notice: Subject to any disclaimer, the term of this patent is extended or adjusted under 35 U.S.C. 154(b) by 960 days.

(21) Appl. No.: 12/006,319

(22) Filed: Dec. 31, 2007

(65) Prior Publication Data

US 2009/0171385 A1 Jul. 2, 2009

(51) Int. Cl.
*A61F 5/08* (2006.01)

(52) U.S. Cl. ..... 606/204.35; 132/200

(58) Field of Classification Search ..... 606/204.35; 128/898

See application file for complete search history.

(56) References Cited

U.S. PATENT DOCUMENTS 765,361 A * 7/1904 Hargrave ..... 606/204.35
1,510,879 A 10/1924 Yachno
3,524,443 A 8/1970 Batlin
3,575,165 A 4/1971 Heale
3,584,619 A 6/1971 Bowser
3,672,363 A 6/1972 Masters
3,736,925 A 6/1973 Erman
4,239,037 A 12/1980 Fausone
4,995,379 A 2/1991 Brooks
5,476,478 A * 12/1995 Jackson ..... 606/204.35
5,555,900 A 9/1996 Rich
5,582,585 A * 12/1996 Nash-Morgan ..... 604/44
2004/0138699 A1 7/2004 Lish

* cited by examiner

*Primary Examiner* — Tuan V Nguyen

(57) ABSTRACT

A cosmetic device for naturally toning the facial and the upper neck muscles of a user. The device includes a pair of adhesive pads for adhering to the user's facial skin, a pair of supporting earpieces connected to the adhesive pads, and a strap connecting the pair of earpieces. The length of the strap is to be adjusted until a desired tension is placed on the pads. The tension causes the pads to stretch the skin and thereby tone the facial and upper neck muscles naturally over a period of time for creating a more youthful look.

10 Claims, 8 Drawing Sheets

FACELIFT DEVICE

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to cosmetic devices, and more particularly to a facelift device for naturally toning the facial and the upper neck muscles of a user thereby creating a more youthful appearance. The facelift device is simple in its structure and is easy to handle as a user can carry out the operation of the device alone.

Several such devices are known in the art. For example, U.S. Pat. No. 4,239,037 to Fausone discloses a face fining equipment comprising a hair piece that is to be rested over a users head. The hair piece is attached with a comb, which anchors the hair piece to the hair. The top surface of the hair piece is further attached with artificial hair in order to conceal it. The equipment further comprises a strip of material, whose top surface is overlaid with Velcro™. The central portion of the strip is attached to the central portion of the hair piece. The hair piece is made of a flexible, resilient material so that the Velcro™ on the top surface of the sides of the strip can be accessed by bending the sides of the hair piece upwards. The equipment further comprises adhesive elements which include Velcro™ for engaging the Velcro™ on the strip. An elastic band extends from the adhesive element and terminates in an adhesive pad, which adheres to the user's facial skin. Depending on the arrangement of the adhesive elements on the strip, tension is produced at the adhesive pads, which in turn pulls the skin upward so as to remove the wrinkles and the like.

U.S. Pat. No. 3,736,925 to Erman discloses a face-lifting apparatus comprising a plate with four aligned holes and two spaced-apart grooves. An elastic line is threaded through the four holes and is sufficiently slack between the two central holes so as to form an extended loop, which is to be wedgedly fitted into the two grooves. Each end of the elastic line terminates in a ring through which a plurality of strings are inserted and suspended. An adhesive tab is hooked to each end of a string. In order to use the apparatus, the tabs are attached to the skin as the plate is placed over the head, and the elastic line adjusted such that sufficient tension is produced at the pads, which enables the skin to be stretched and thereby treated eventually. The plate needs to be concealed by the user's hair.

U.S. Pat. No. 3,524,443 to Batlin discloses a facial skin supporting device that is to be worn over a user's head. The device comprises a nylon line, with each of its end terminating in an adhesive pad, which is to adhere to the user's facial skin. The device further comprises an anchor member comprising a plate member and a retaining clip; the retaining clip pivoted to the plate member. The anchor member is used for holding adjusted portions of the nylon line in selected position of tension while it is fastened to the user's hair.

All of the art disclosed above includes a component which needs to be concealed within the user's hair. This clearly poses a problem to those who are bald or to those who doesn't have ample hair. Also in the present invention, the adhesive pads tend to pull the skin backwards, unlike what is seen in the above art, where the adhesive pads/tabs pull the skin upwards. The objects of the present invention will become better understood with reference to the appended Summary, Description, and Claims.

SUMMARY

The present invention is a facelift device which is employed for toning the facial muscles of a user for creating a youthful appearance. The device comprises includes a pair of adhesive pads, a pair of supporting earpieces connecting to the adhesive pads, and an adjustable strap connecting the earpieces. The pads are constructed to adhere to the users facial skin, while the earpieces go around the ears of the user. The strap, which connects the earpieces, can be adjusted to place tension on the pads, which causes the skin to be pulled backwards, and thereby tone the facial and upper neck muscles naturally over a period of time for creating a more youthful appearance.

FIGURES

Reference Numerals

Figure 1:
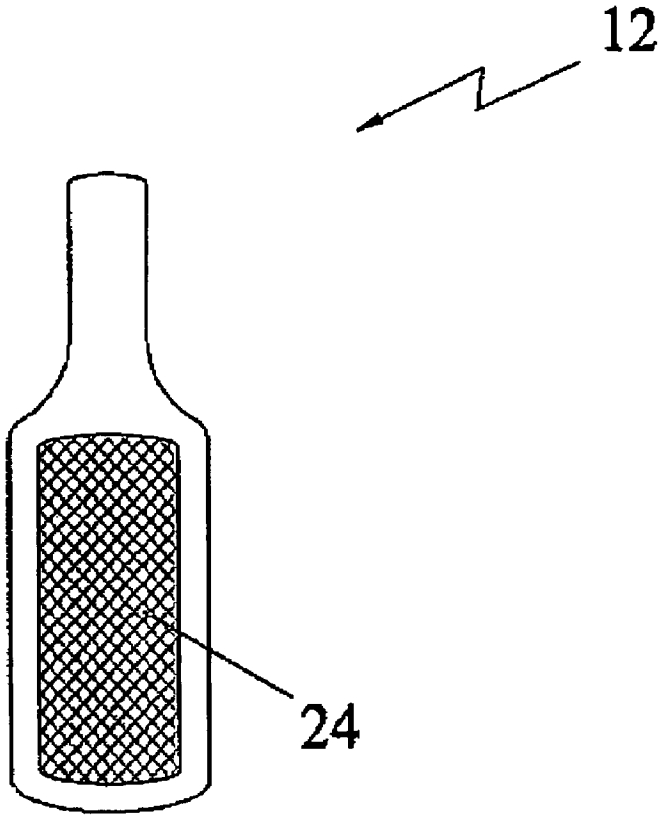
FIG. 1 is an enlarged plan view of an adhesive pad in accordance with the present invention.
Figure 2:
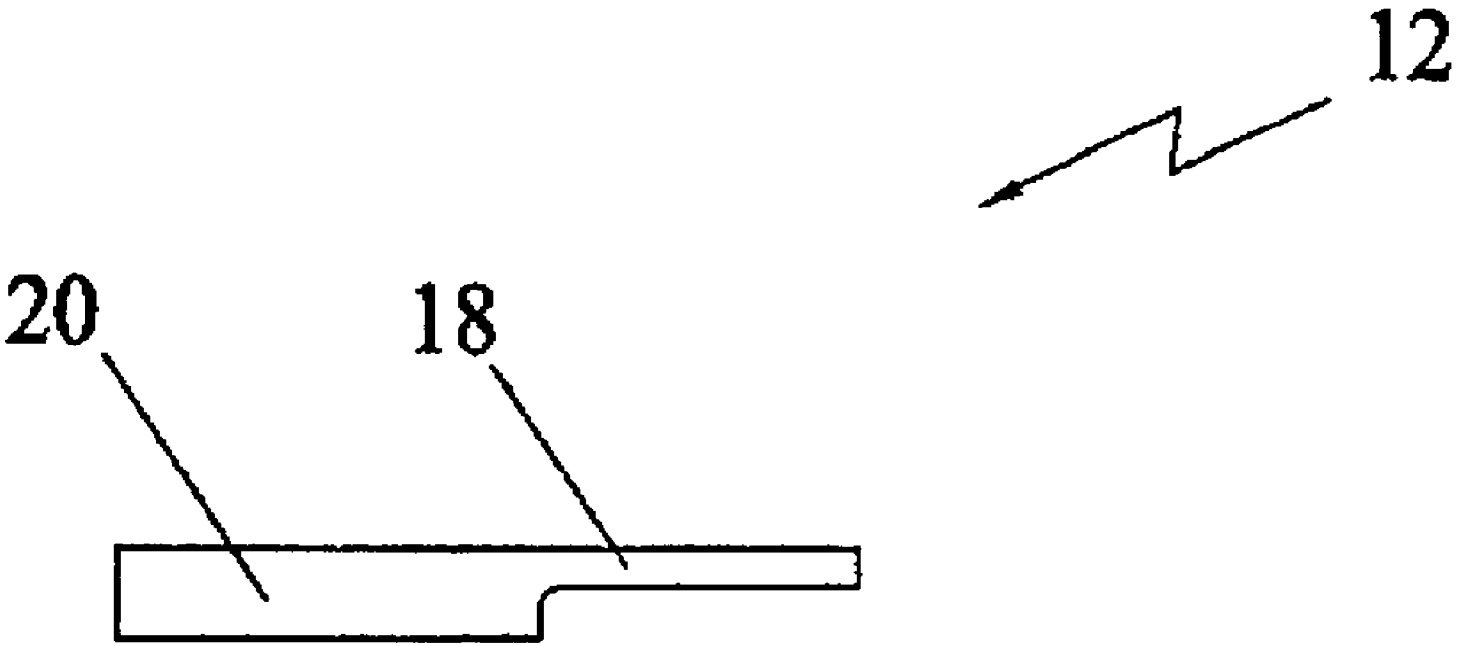
FIG. 2 is a side view of an adhesive pad in accordance with the present invention.

10 Facelift Device
12 Adhesive Pad
14 Earpiece
16 Adjustable Strap
18 Small Portion
20 Body Portion
24 Adhesive Surface
26 Rectangular Hole
28 Ear
30 Clasp Member
32 Variable Loop
34 Fixed Loop
36 Arrow

DETAILED DESCRIPTION

Referring to the drawings, a preferred embodiment of a facelift device 10 is Illustrated in FIGS. 1 through 8. The device 10 is used for naturally toning the facial and upper neck muscles of a user. The device 10 comprises a pair of adhesive pads 12 supported by a pair of earpieces 14, and an adjustable strap 16 connecting the earpieces 14.

Referring to FIG. 1, the adhesive pad 12 can be divided into a small portion 18 and a body portion 20, where the small portion 18 extends from one end of the body portion 20. The small portion 18 may have adhesive on the side opposite the adhesive that is on the body portion 20. The small and body portions, 18 and 20, may be of any shape. In the present disclosure, they are shown as substantially rectangular on plan and lie on the same plane.

The body portion 20 comprises adhesive surface 24 on one side of the body portion 20. The small portion 18 may have adhesive surface 24 on the side opposite the adhesive surface 24 that is on the body portion 20. The adhesive surface 24 is preferably covered by a liner, such as, wax paper. The adhesive surface 24 should have enough adhesion to adhere to the users facial skin but yet easily removed from the user skin. At the time of use, the liner is removed and adhesive pad 12 is adhered to the user's facial skin, ideally over the temple/cheekbone area. The adhesive pad 12 may also be disposable such that it can be replaced when desired or when it no longer adheres to the skin.

Figure 3:
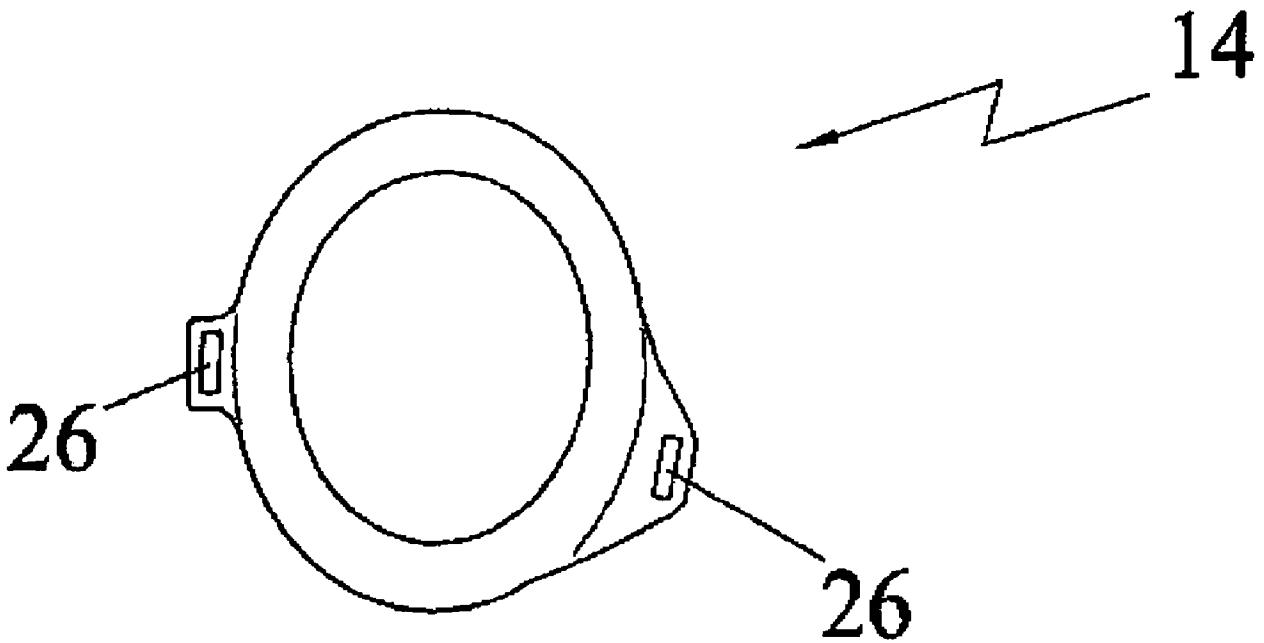
FIG. 3 is a plan view of the earpiece in accordance with the present invention.
Figure 4:
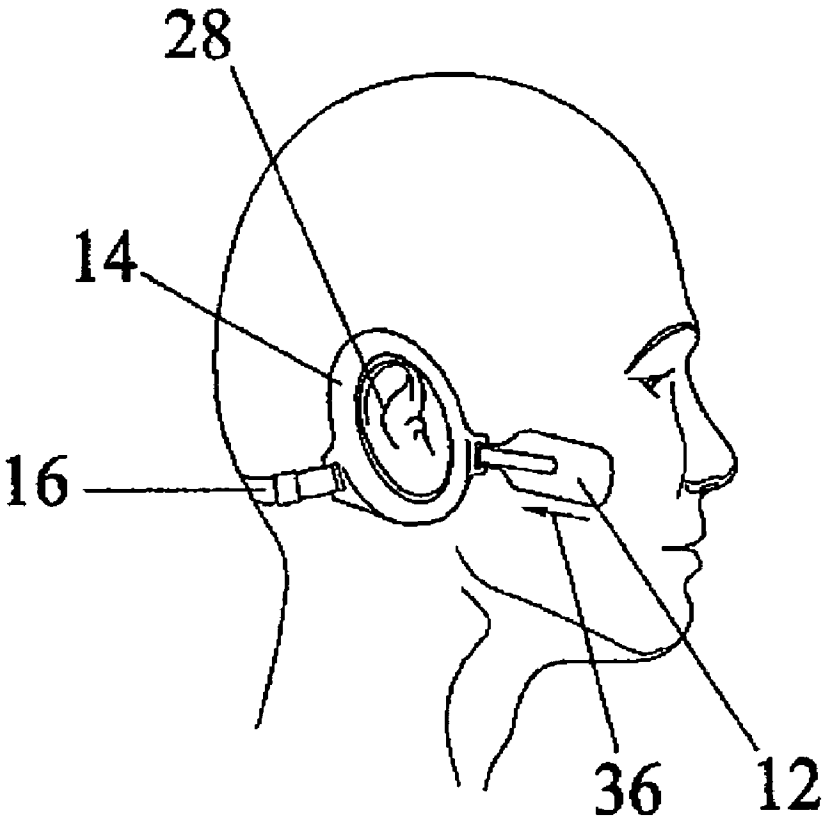
FIG. 4 is a side view of the device fitted to the user's head in accordance with the present invention.

Referring to FIGS. 3 and 4, the earpiece 14 is a ring having two holes 26, front and rear, extending radially from the circumference thereof. The holes 26 may be rectangular. The front hole 26 of the earpiece 14 receives the small portion 18 which is passed through hole 26. The small portion 18 is folded back over to form a loop and secured to adhesive pads 12. This secures adhesive pads 12 to the earpiece 14. The earpiece 14 is designed to fit around the users ear 28 as the adhesive pads 12 adheres to the user's skin.

Figure 5:
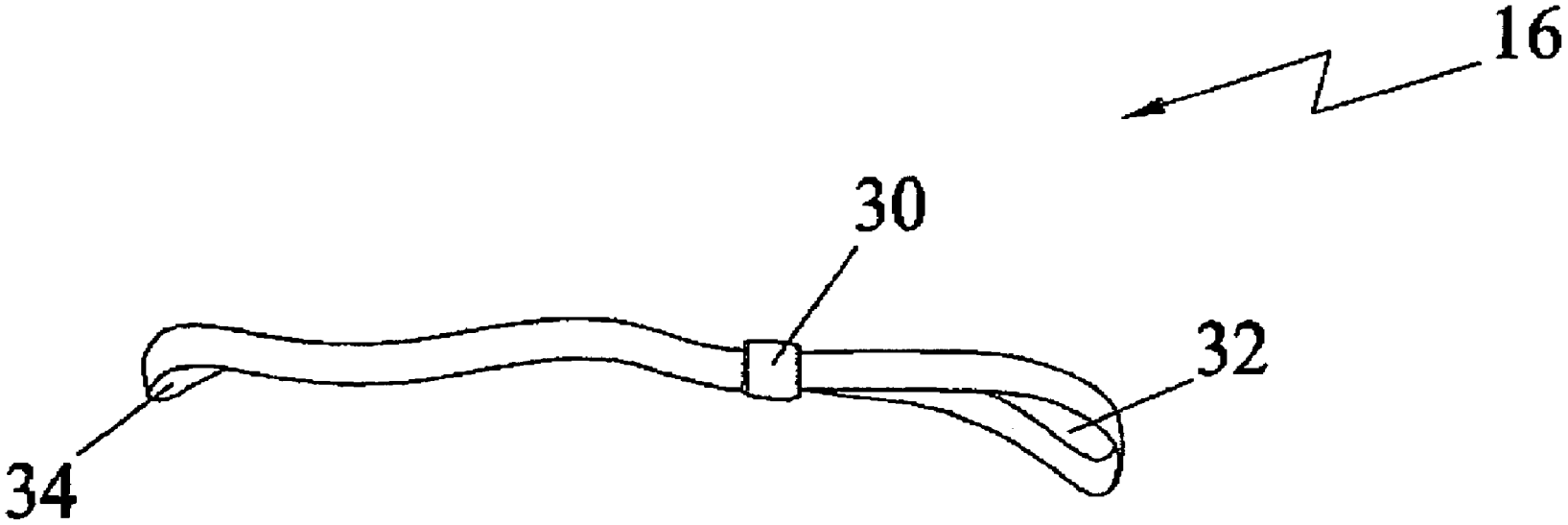
FIGS. 5 and 6 are the illustrations of the adjustable strap in accordance with the present invention.
Figure 6:
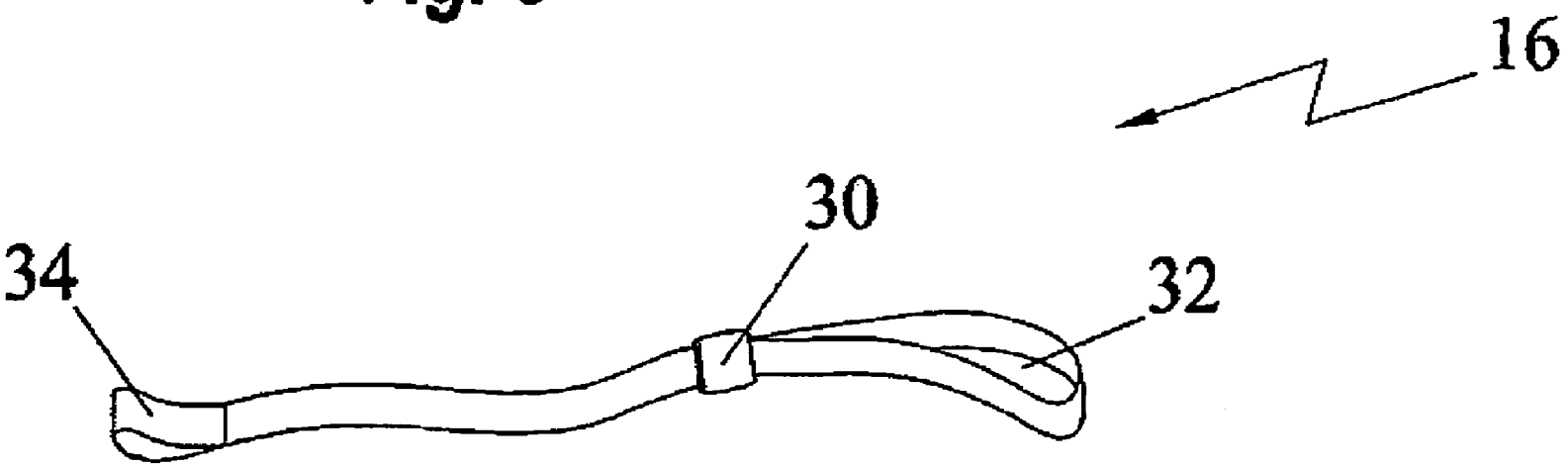

Referring to FIGS. 5 and 6, the adjustable strap 16, connects the pair of earpieces 14. Preferably adjustable strap 16 is made of an elastic material. The strap 16 includes a clasp member 30 that can slide along the length of the strap 16. The clasp member 30 can be locked at any point along the length of the strap 16. One end of the strap 16 is attached to the clasp member 30 so as to form a variable loop 32. This allows the length of the strap 16 to be adjusted by varying the size of the loop 32. This is done by changing the position of the clasp member 30. The other end of the strap 16 terminates in a fixed loop 34.

Figure 7:
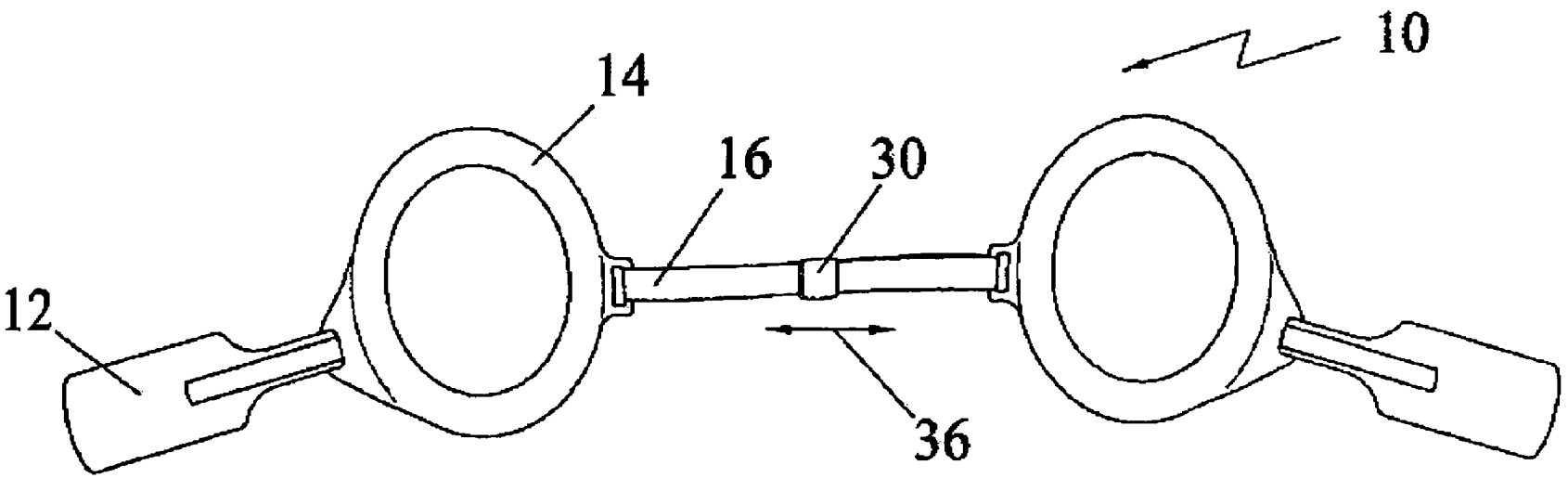
FIG. 7 is an illustration of the facelift device in accordance with the present invention.
Figure 8:
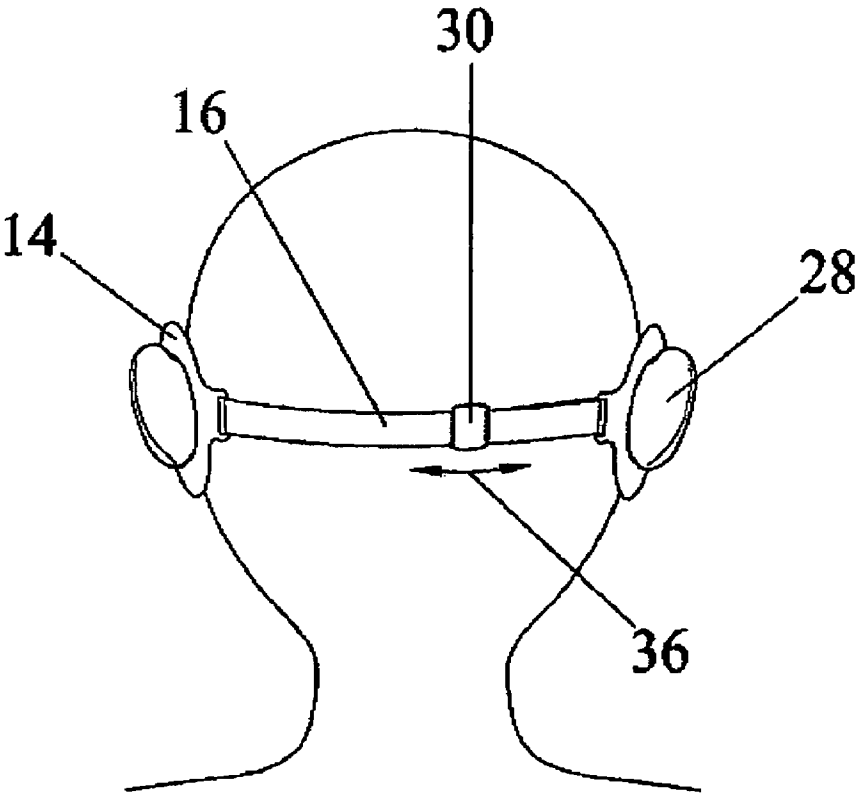
FIG. 8 is a rearview of the device fitted to the user's head in accordance with the present invention.

Referring to FIGS. 7 and 6, the fixed and variable loops, 32 and 34, are to be received within the rear holes 26 of the earpieces 14. When the earpieces 14 are worn and the adhesive pads 12 are adhered to the user's skin, the length of the strap 16 is to be adjusted, as indicated by arrow 36, so as to place a desired amount of tension on the pads 12. This tension causes the skin to be stretched backwards, as indicated by an arrow 36 in FIG. 4, and thereby tone the facial and upper neck muscles of the user naturally over a period of time. The adhesive pads 12, earpieces 14, and strap 16 are made of a soft and resilient material so as to permit the tension to be maintained at all times, irrespective of the movement of the facial muscles, such as when laughing, eating, and the like.

To naturally tone the skin and facial muscles of a user the pair of adhesive pads 12 is provided for adhering to the skin, especially over a temple/cheekbone area. A pair of supporting earpieces 14 that go around the ears of the user, each earpiece connected to an adhesive pad 12. An adjustable strap 16 connects the pair of earpieces 14, the strap 16 when worn abuts the back of the head. The length of the strap 16 is adjusted until the desired tension is placed on the pads 12. The tension stretches the skin backward and thereby naturally tone the facial muscles and upper neck muscles over a period of time creating a more youthful look.

To use the facelift device 10 of the present invention the earpieces 14 are placed around the ears of the user. The adhesive pads 12 is adhered to the user's skin and the length of the strap 16 is adjusted to the desired tension.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A facelift device for toning the facial muscles of a user, the device comprising:

(a) a pair of adhesive pads for adhering to the user's skin, wherein each of the adhesive pads comprises a small portion, a body portion and an adhesive surface for adhering to the user's skin;

(b) an earpiece coupled to each of the pair of adhesive pads; wherein the earpiece comprises an enclosed ring that configured to wear around the ear of the user, wherein the earpiece comprises two holes, and wherein the holes define a front and rear holes, the small portion of the adhesive pad is coupled to the front hole of the earpiece; and (c) an adjustable strap connecting the earpieces, wherein the adjustable strap comprises an adjustable length and two opposed ends, wherein each of the opposed ends of the adjustable strap terminates in a loop, each loop is received within the rear holes of the earpieces thereby connecting the earpieces, wherein the adjustable strap lies tension to the pair of adhesive pads, and wherein the tension configured to cause the pair of ad pads ads to stretch the skin backwards.

2. The device of claim 1, wherein the small portion comprises an adhesive surface.

3. The device of claim 1, wherein the pair of adhesive pads are disposable.

4. The device of claim 1, wherein the adjustable strap is made of an elastic material.

5. The device of claim 1, wherein the loops define first and second loops, the first loop being fixed, while the second loop defines a size, wherein the size being adjustable, the adjustable length of the adjustable strap being adjustable by varying the size of the second loop.

6. The device of claim 5, wherein the second loop is defined by attaching an end of the opposed ends of the adjustable strap to a clasp member that can slide along the adjustable length of the adjustable strap; the clasp member can be releasably locked at any point along the adjustable length of the adjustable strap.

7. The device of claim 1, wherein the pair of adhesive pads are made of a resilient, soft material so as to permit a tension applied by the adjustable strap to the pair of adhesive pads to be maintained at all times.

8. The device of claim 1, wherein the adjustable strap is made of a resilient, soft material so as to permit a tension applied by the adjustable strap to the pair of adhesive pads to be maintained at all times.

9. The device of claim 1, wherein the earpieces are made of a resilient, soft material so as to permit a tension applied by the adjustable strap to the pair of adhesive pads to be maintained at all times.

10. The device of claim 1, wherein the adjustable strap configured to about the backside of the user's head.

* * * * *